United States Patent [19]

Eisenberg

[11] 4,144,659

[45] Mar. 20, 1979

[54] SKI BOOT

[76] Inventor: Joel H. Eisenberg, 53A Blackhawk La., Stratford, Conn. 06497

[21] Appl. No.: 875,178

[22] Filed: Feb. 6, 1978

[51] Int. Cl.[2] ..... A43B 5/04; A43B 13/18; A63G 9/16

[52] U.S. Cl. ..... 36/120; 36/28; 272/96

[58] Field of Search ..... 36/117, 118, 119, 120, 36/121, 102, 28, 114; 272/96

[56] References Cited

U.S. PATENT DOCUMENTS

| | | | |
|---|---|---|---|
| 886,801 | 5/1909 | Harmon | 36/28 |
| 1,380,879 | 6/1921 | Young | 36/28 |
| 3,067,531 | 12/1962 | Scott et al. | 36/120 |
| 3,303,584 | 2/1967 | Werner et al. | 36/120 |
| 3,775,875 | 12/1973 | Dvorsky | 36/117 |
| 4,074,446 | 2/1978 | Eisenberg | 36/120 |

FOREIGN PATENT DOCUMENTS

| | | | |
|---|---|---|---|
| 1058541 | 11/1953 | France | 36/28 |
| 103541 | 1/1964 | Norway | 272/96 |

*Primary Examiner*—Patrick D. Lawson
*Attorney, Agent, or Firm*—Wooster, Davis & Cifelli

[57] ABSTRACT

A ski boot comprising an outer boot having a sole on which an improved foot supporting insert rests so as to be selectively laterally tiltable relative to the sole within the shoe. Inversion or eversion of the foot alone causes the insert to tilt, thereby creating a weight shift which is transferred to the lateral edge of a ski attached to the boot causing it to turn. Skiing maneuvers are, therefore, accomplished without twisting the torso or laterally moving the knees of the skier. The insert includes a foot supporting portion made of a suitable material and configured so that in its free state it does not necessarily conform to the sole of the foot of the skier, but which does so conform when it is mounted in a ski boot and the foot of the user is operatively mounted in the ski boot on the insert. The insert is also adapted to be used with an ice skate shoe for use in ice skating and functions essentially in the same manner as when incorporated in a ski boot.

12 Claims, 8 Drawing Figures

Fig. 4.
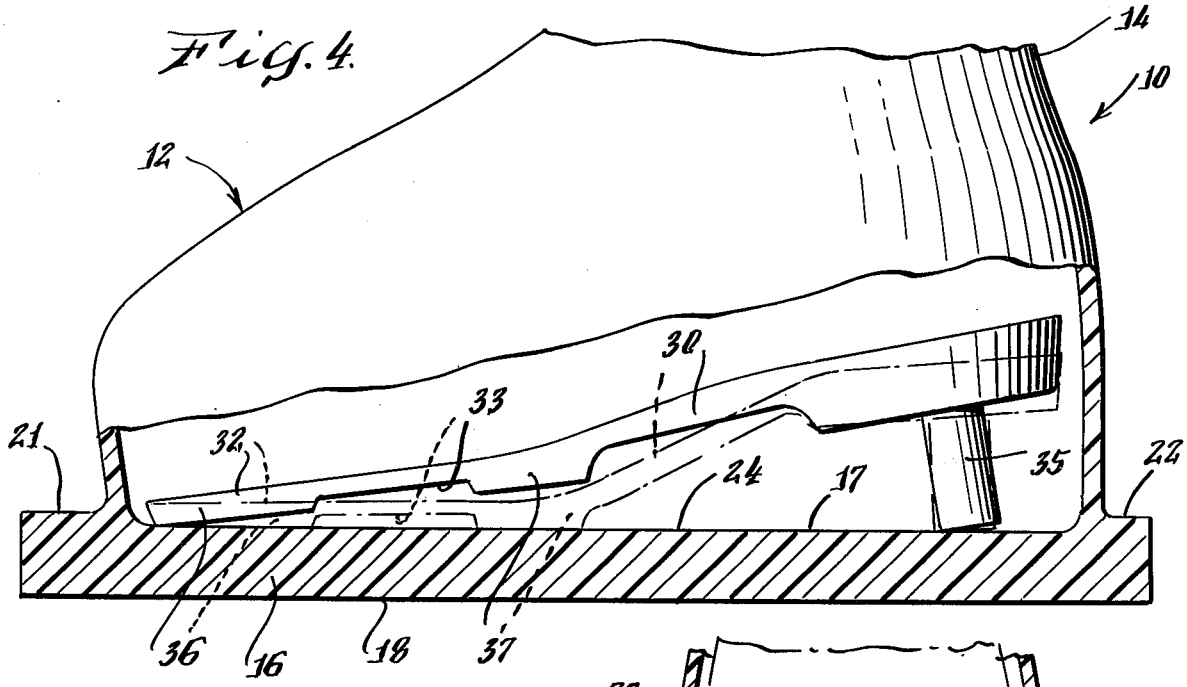
Fig. 7.
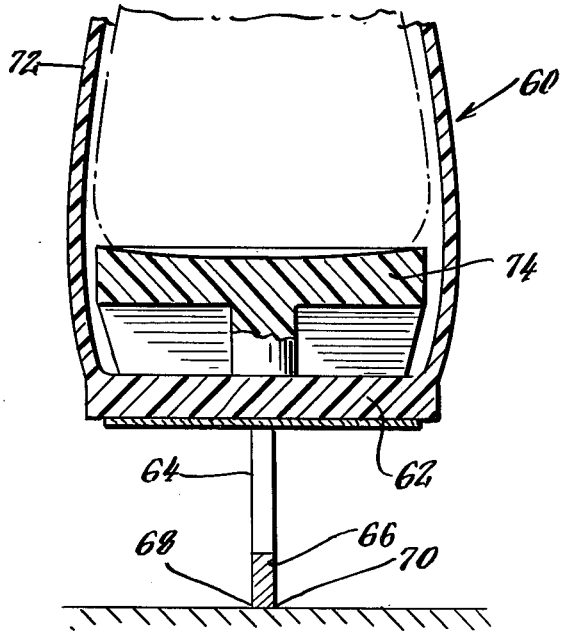
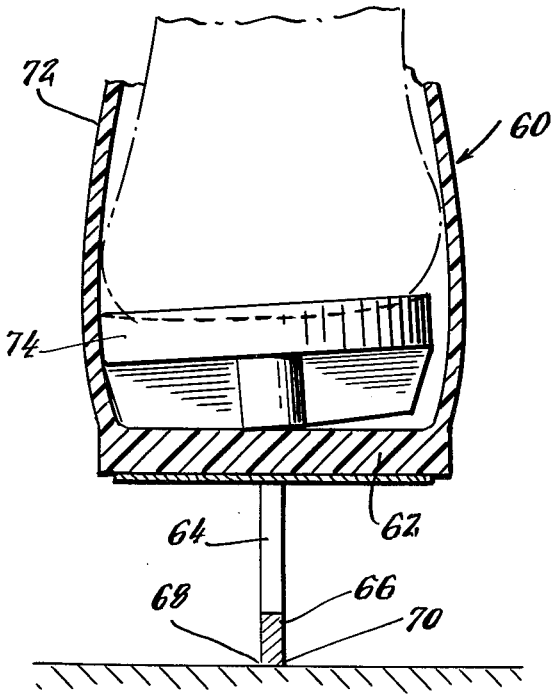
Fig. 8.

SKI BOOT

BACKGROUND OF THE INVENTION

This invention primarily relates to an improvement in ski boots, particularly in regard to the manner in which the ski boot functions with respect to the foot and the leg of the skier in turning or maneuvering. It constitutes an improvement on the ski boot invention disclosed and claimed in my copending application Ser. No. 697,437 filed June 18, 1976, particularly in the means for supporting the feet in the boots.

In skiing, the skier turns by shifting his weight so that it is temporarily transferred to either the inside or the outside edges of his skis. This causes an unbalanced effect on the skis, and they turn in the direction of the weighted edges. In short, it is this weighting and corresponding unweighting of the sides of the skis which permits the skier to maneuver as he skis down a hill.

In the prior art, the ski boot is locked to the ski by binding and the ski boot cannot move in any direction without producing a corresponding movement in the ski. As the foot and the ankle of the skier are firmly and substantially immovably held in the prior art ski boot so that movement of the skier's foot without moving his leg is not possible, the skier turns by twisting his entire torso. The knees of the skier are laterally moved in the direction of the turn, bending his lower legs outwardly causing the boot to tilt and thereby shifting weight to the edge of the ski as required. Unfortunately, this lateral movement of the knee tends to turn the foot itself and the ski in the opposite direction against the turn. As a result, the skier expends a substantial amount of energy in turning and experiences a substantial strain particularly with respect to the knees.

Furthermore, as a result of this arrangement the prior art ski boots must be fabricated so that the sidewalls are strong enough to lock the ankle and foot in place, but at the same time flexible enough to permit the skier to bend his leg laterally in order to turn.

The prior art ski boots, therefore, do not take advantage of the foot's natural lateral tilting movement, which is known as inversion and eversion. In terms of bone structure, the foot has a subtalar joint, formed by the talus and the oscalis, which is responsible for most of the lateral movement of the foot. Because of this subtalar joint, the foot can be tilted without moving the remainder of the leg, and it is, therefore, possible to shift the weight of the body just by inverting or everting the foot without laterally moving the knees or twisting the torso. However, the subtalar motion or inversion and eversion of the foot cannot exist if the ankle and the foot are held in place as they are in prior art ski boots some of which are even form fitted to the individual's feet.

Accordingly, the prior art ski boot design is unsatisfactory from a number of standpoints, particularly since it does not permit the skier to turn easily without a great expenditure of energy and stress on various parts of the body, such as the knees and torso.

SUMMARY OF THE INVENTION

The foregoing background is common to my referred-to copending application and this application, and equally applicable. In my copending application, an improvement for ski boots according to the invention was provided which comprised means whereby the natural inversion and eversion of the foot can be employed by itself to shift the weight of a skier thereby turning the skis. The invention generally comprised a ski boot at least a portion of which is laterally tiltable with respect to the ski along the longitudinal axis by merely inverting and everting the foot. The skier can, therefore, shift his weight with relation to the edge of the skis and turn simply by a slight foot movement.

In one embodiment of the invention of my copending application, a tiltable insert is used in an existing ski boot. The insert comprises a plate having a balancing point on its bottom which is inserted into a ski boot so that it balances on the inside sole of the boot. The plate is free to laterally tilt inside the ski boot which is secured to the ski in the usual manner. The foot of the skier, which is movable in the ski boot, rests upon the top of the plate. The skier can shift his weight by tilting his foot inside the boot which causes a corresponding tilt in the insert. This weight shift is transmitted to the edge of the skis while the boot and ski remain level.

Although the invention of my copending application is entirely satisfactory for its intended purposes, my present invention deals with an improvement in the insert which enhances its functioning, materially improves its comfort and renders it readily manufacturable at a low cost.

The invention described herein can be incorporated into a specially designed boot or added as an addition to an already existing ski boot. The tilting of the foot itself with this invention will cause a corresponding weight shift to the edge of the ski resulting in the skis turning without the need for corresponding twisting, straining and lateral movement of the knees and torso of the skier.

Accordingly, a principal object of the present invention is to provide a ski boot which facilitates turning and maneuvering.

Another object of the present invention is to provide a ski boot whereby the weight shift to the edge of the skis is accomplished by movement of the foot instead of substantial lateral movement of the knees and twisting of the torso.

Another object of the present invention is to provide an insert which can be easily adapted to existing ski boots, functions in an improved manner, is materially more comfortable and lends itself to low cost mass production.

It is still another object of this invention to provide an improved ice skate.

Other and more specific objects of the invention will be in part obvious and will in part appear from the following description of the preferred embodiments and claims taken together with the drawings.

BRIEF DESCRIPTION OF THE DRAWINGS

FIG. 4 is a view similar to FIG. 1, but showing the insert in solid lines in the position it takes when not mounted on the foot of a skier, and in dotted lines when so mounted;

FIG. 7 is a vertical sectional view taken through an ice skate in which my improved insert is mounted, and FIG. 8 is a similar view to FIG. 7, but showing the insert tilted to effect a turn of the ice skate.

The same reference numbers refer to the same elements throughout the various Figures.

DESCRIPTION OF THE PREFERRED EMBODIMENTS

Referring now to FIGS. 1–4, a first embodiment 10 of a ski boot according to the invention is shown. The ski boot 10 generally comprises two main elements which are an outer boot 12 and a movable insert 30.

Figure 1:
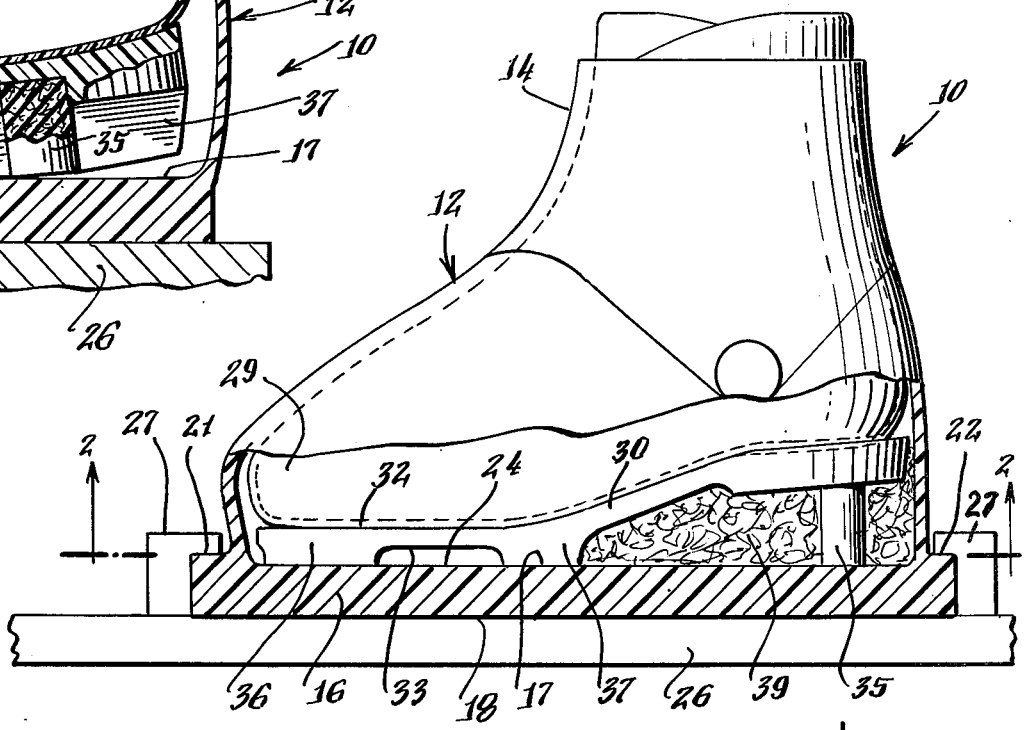
FIG. 1 is a side view of the ski boot according to the invention herein with the lower portion cut away showing the improved insert in position when mounted on the foot of a skier.

As shown in FIG. 1, the outer boot 12 generally comprises an upper shell 14 which is substantially inflexible and secured to a boot sole 16. The boot sole 16 is substantially rectangular and of considerable thickness. The boot sole 16 has a top surface 17 and a bottom surface 18. As shown in FIG. 1, a small portion of the top surface 17 extends beyond each end of the upper shell 14 forming a front lip 21 and a rear lip 22. The remaining portion of the top surface 17 of the sole 16 which is disposed inside the upper shell 14 comprises the inside base 24 of the outer boot 12.

The outer boot 12 is fixed to a ski 26 by means of a pair of bindings 27 which are secured to the ski 26. When the outer boot 12 is in place on the ski 26, the bottom surface 18 of the sole 16 rests upon the ski 26, as shown in FIG. 1. The bindings 27 are selectively attached to the front lip 21 and the rear lip 22 of the outer boot 12 thereby holding the outer boot 12 to the ski 26 unless the bindings 27 are released. When the outer boot 12 is so in place, the outer boot 12 cannot move independently of the ski 26. An insulated inner boot 29 fits inside the upper shell 14 of the outer boot 12, and in the prior art the insulated boot 29 would rest upon the inside base 24 of the sole 16 and be immovable inside the outer boot 12. The insulated inner boot 29 of this invention, however, is laterally movable inside the upper shell 14 of the outer boot 12.

Figure 2:
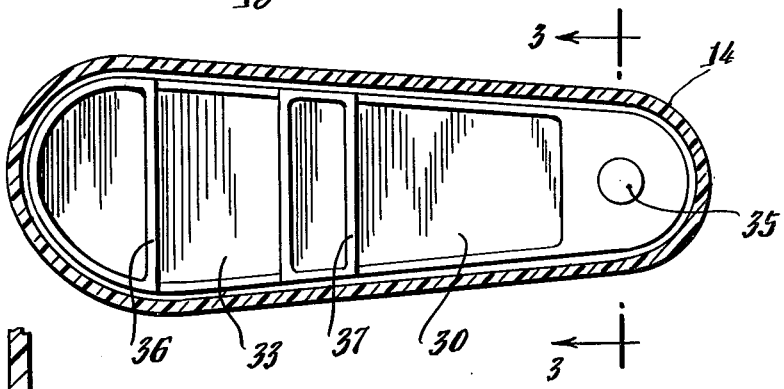
FIG. 2 is a sectional view of the ski boot taken substantially along lines 2—2 of FIG. 1.

As shown in FIG. 1, an insert 30 is disposed in the outer boot 12 between the sole 16 and the inner insulated boot 29. The insert 30 is generally plate-like and has an upper surface 32 and a lower surface 33. As shown in FIG. 2, the insert 30 is substantially foot shaped and has a single rear balance post 35 disposed at its lower surface 33 near the heel. A toe balance area 36 is disposed at one end of the lower surface 33 of the insert 30 opposite the rear balance post 35. Intermediate the ends of the insert on the lower surface is formed a metatarsal balance area 37.

In the preferred form illustrated in FIGS. 1–4, the insert 30, except for its balance post 35, is formed of a suitable plastic material. The balance post 35 comprises a cylinder formed of a resilient material that is secured in a socket formed at the heel end in the lower surface 33. The post 35 may be secured in the socket in any convenient manner, as by cementing or a friction fit. However, if desired, the post 35 may simply be loosely fit in the socket and otherwise unsecured to the insert, in which event the operation some relative movement between the insert and the post 35 may occur. Further, if desired, the socket may be eliminated, and the post 35 be in planar contact with and either separate from or secured to the plate-like portion of the insert. When in its free unstressed condition, insert 30 takes the configuration shown in FIG. 4 in solid lines. The plastic material of which insert 30 is made is selected to be sufficiently stiff to maintain its unstressed shape, but to be sufficiently flexible so as to be deformable, when mounted in a ski boot and a skier's foot is disposed in the boot, to conform to the sole of the skier's foot, such as shown in dotted lines in FIG. 4. The insert is multi-sized in that a single size insert will accommodate a range of foot sizes.

Figure 3:
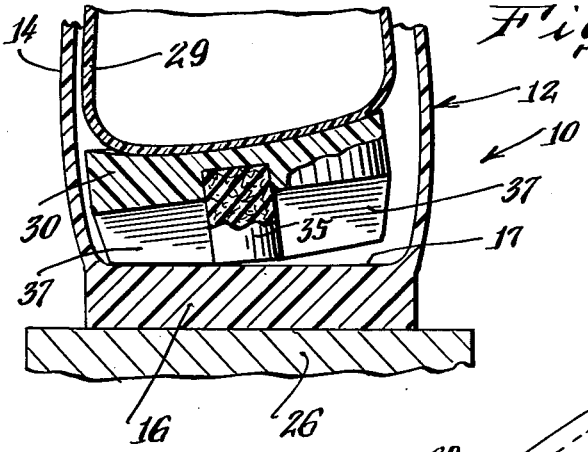
FIG. 3 is a cross-sectional view of the ski boot taken substantially along lines 3—3 of FIG. 2.
Figure 5:
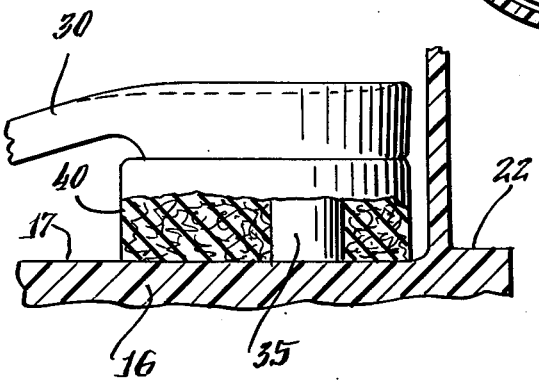
FIG. 5 shows the rear portion of the FIGS. 1–4 insert encased in a very spongy material which aids in the operation of the insert.

The insert 30 is sized relative to the interior of the ski boot so as to be capable of tilting with respect to the outer boot 12, as shown in FIG. 3. When the insert 30 is operational in the outer boot 12, ordinarily the bottom of the rear balance post 35 and the balance areas 36 and 37 rest in planar contact with the inside base 24 of the top surface 17 of the sole 16 of the outer boot 12, as shown in dotted lines in FIG. 4. The lower surface 33 of the insert 30 is not otherwise in contact with the inside base 24. The balance points formed by 35–37 are disposed in such a manner that when weight is placed on and substantially evenly distributed over the upper surface 32 of the insert 30, the insert 30 remains in a level or horizontal position with respect to the outer boot 12 and the ski 26, as shown in FIG. 1. The insert 30 does not contact the sides of the upper shell 14 of the outer boot 12 and, therefore, if the weight on the upper surface 32 of the insert 30 is shifted to one side or the other, as it would be with either inversion or eversion of the foot, the insert 30 will tilt in relation to the outer boot 12 and ski 26. Weight shifting and tilting in one direction is shown in FIG. 3. The weight shift is transmitted to the corresponding outer edge of the ski 26 causing the ski to turn in the direction of weight shifting and tilting without substantial movement of the outer boot 12 and, therefore, without severe lateral movement of the knees or the torso. This weight shift can be accomplished entirely by inversion or eversion of the skier's foot within the outer boot 12, as it is inside the inner boot 29 which rests upon the top 32 of the insert 30 and has clearance to move laterally. As shown in FIG. 1, a compressible substance 39 may be disposed between the lower surface 33 of the insert 30 and the inside base 24 of the sole 16 of the outer boot 12. The compressible substance 39 acts to aid the insert 30 in returning to its normal level or horizontal position after the insert has been tilted and the weight has once again become evenly distributed over its upper surface 32. The compressible substance 39, for clarity is omitted from all of the figures other than FIG. 1. As shown in FIG. 5, the compressible substance may conveniently take the form of a mass 40 of spongy resilient material molded about the rear underside of insert 30 to encase the balance post 35 and thereby form a part of the insert.

Figure 6:
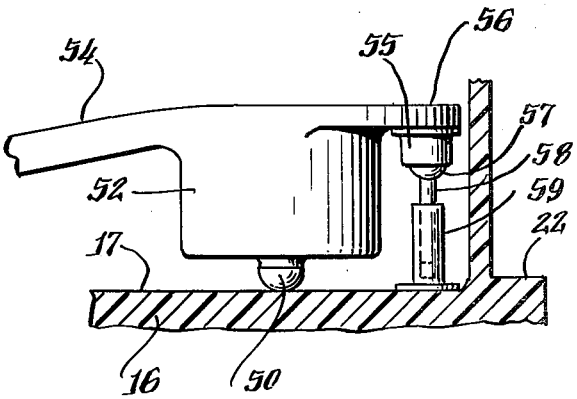
FIG. 6 is a fragmentary view of the heel end of a modified insert.

The insert 30 of the FIGS. 1–4 embodiment may be modified as illustrated in FIG. 6 so as to provide a unitary structure by forming the rear balance post 50 integrally with the heel portion 52 of the illustrated modified insert 54. It will be understood that in this modified form of insert the entire insert 54 may be made in one integral piece, as by molding. If so, it may conveniently be molded of a sufficiently stiff, but flexible, plastic material.

In FIG. 6, there is illustrated an optional feature incorporated into the FIG. 6 form of insert, but it may be incorporated into any embodiment of insert disclosed herein. With this feature, the boot is modified to provide a means for effecting a very secure mounting arrangement for the insert. A ball socket bracket 55 is rigidly secured to the underside of a rearwardly extending overhang 56 on the insert 54 at the heel end thereof. The ball portion 57 of a swivel ball 57—pin 58 unit is mounted in the socket of bracket 55 and swivelly depends therefrom. A hollow cylinder bracket 59 is rigidly mounted at its base to the inside base 24 of the boot sole 16. The arrangement is such that the pin 58 is selectively detachably secured in the opening in the cylinder bracket 59 when the insert is operatively disposed in the ski boot. With the optional addition of this feature, a very secure pivotal arrangement is effected which does not interfere with the tilting action of the insert.

The improved inserts 30, 54, described thus far, may be used with existing ski boots of an appropriate size. It is contemplated that as a practical matter, the benefits of my invention may be derived by either purchasing a pair of ski boots which include my improved inserts or by purchasing the inserts alone and using them with a pair of ski boots already available to the skier, if such be the case and desire of the skier. In other words, my improved inserts negate the necessity of purchasing new ski boots, as long as boots are available that are large enough in their interiors to accommodate the inserts with sufficient clearance to allow them to tilt relative to the outer sheels of the boots.

The invention has its principal application in connection with boots for the sports art of skiing; however, the improved inventive concept of this invention may be applied to some advantage in connection with equipment for the sports art of ice skating.

An ice skate for purposes of this disclosure may be considered to be broken down into two components, namely, the shoe portion and the blade portion. Together, they produce a relative functional phenomenon similar to that of a ski boot on a ski. Shifting the weight over the medial edge would cause the ice skate to turn to that side when going forward. Shifting to the other edge would cause the skate to turn to that side. Similar techniques to those applied to the ski boot embodiments of my invention apply to an ice skate application thereof, to cause a shift of the center of gravity over one edge or the other of the blade of the ice skate with a consequential desired turning of the ice skate. This could be done with the present type of ice skates and would allow ice skates to be made with a more rigid shoe component, such as rigid and semi-rigid plastic shoes, so that instead of bending over the shoe component itself as presently required, one would shift the center of gravity within the shoe portion.

In FIGS. 7 and 8 there is illustrated an embodiment of an improved ice skate incorporating my inventive concept. Heretofore, the basic principles of ice skating have been generally similar to the basic principles of skiing, prior to the advent of my invention involving ski boots disclosed and claimed in my referred-to copending application. The conventional wisdom in both sports involved the concept of "edging", that is, sliding on a selected lateral edge of a flat bottomed member (ski or runner) having a pair of spaced, elongated, parallel edges. In the case of the ski, the spacing of the parallel edges if significantly greater than that of the parallel edges on the runner of an ice skate. Nonetheless, the basic geometry and principles of my invention still apply, that is, it is weight shift, rather than "edging" which causes turning, and such weight shifting can best be effected by employing my eversion-inversion concept. Heretofore, much of the strain and discomforture of ice skating has resulted from the need to tightly mount the ice skates on the feet of the skater to, in effect, create almost rigid extensions of the legs to the feet to the runners. Turning on ice skates has been effected by edging one or the other edges of the runners to effect the desired turn. The basic concept of weight shifting which I have discovered and employ in my improved ski boots applies to a substantial extent in ice skates.

In FIG. 7 there is illustrated, somewhat schematically in transverse cross section, taken through a vertical plane near the heel and looking forward, an ice skate shoe 60 having a sole 62 to the underside of which is secured a conventional runner assembly 64 having a runner 66 with spaced, parallel, longitudinally extending edges 68 and 70. The ice skate shoe 60 is selected so that its upper portion 72 is securely fastenable to the ankle of the skater. The skater's feet are shown in dot-dash lines in FIGS. 7 and 8, and may be disposed in inner ice skate boots if desired. However, contrary to practice heretofore, the interior of the shoe 60 is slightly oversized to permit the insertion of a tiltable insert 74 which may be constructed in the same manner as the inserts 30 or 54 heretofore described. The selective tilting of the insert 74 relative to the ice skate shoe 60 shifts the weight to one lateral side or the other with the consequential placing of the weight on either of the edges 68 or 70, as selectively desired. Such tilting is selectively effected by either inverting or everting the feet to create the desired direction of tilting. In FIG. 8, the insert 74 is illustrated as tilted toward the left-hand side, as a result of a selective weight shift, thereby placing the effective weight on the left-hand edge 68 and causing the predictable turn in the desired direction. Shifting the weight in the other direction in FIG. 8, toward the right-hand side, would cause the weight to be effective on the runner edge 70 and thereby cause a turn in the opposite direction.

The above description of the invention and its applications is to be construed as illustrative only, rather than limiting. It will be apparent to those skilled in the art that various changes and modifications to the preferred embodiment described herein can be made without departing from the spirit and scope of the invention, which is limited only by the following claims.

I claim:

1. A ski boot for holding a foot of a skier, said ski boot comprising an outer boot having a substantially inflexible upper shell and a sole having an inside base; support means disposed within said outer boot on said inside base in such a manner that said support means is capable of being laterally tiltable with respect to the ski and said outer boot upon inversion or eversion of said foot, and means for attaching said ski boot to a ski, said support means comprising a generally plate-like insert having an upper surface and a lower surface, said insert being configured so that when said insert is in its free state said upper surface does not necessarily conform to the sole of the foot of a skier, but said insert being made of a flexible material so as to conform to the sole of the foot of the skier when the ski boot is operatively mounted on the skier's foot, said insert having a rear heel balance means disposed at said lower surface at one end and a front toe balance means disposed at said lower surface opposite said rear balance means, both of said balance means contacting said inside base when said insert is in place.

2. A ski boot as defined in claim 1 which includes an inner insulated boot adapted to receive a foot of the skier, said inner insulated boot fitting within and being laterally movable inside said outer boot.

3. A ski boot as defined in claim 2 wherein said inner insulated boot rests upon said upper surface of said insert.

4. A ski boot as defined in claim 1 wherein said sole is elongated and longitudinally aligned with and attached to the bottom portion of said upper shell, said sole having a base, a compartment section extending inside said outer boot from said upper shell to said base, and said insert being of a substantially smaller dimension than said compartment section so as to be pivotally supported within said compartment section and capable of laterally tilting with respect to said base.

5. A ski boot as defined in claim 1 wherein said insert includes a metatarsal balance means disposed intermediate the ends of said insert in position not normally to do so, but to contact said inside base when the ski boot is operationally mounted on the foot of a skier.

6. A ski boot as defined in claim 1 wherein said insert is an integrally molded unit.

7. A ski boot as defined in claim 1 wherein said insert is a plate-like member formed of flexible material, and said rear balance means comprises a separate mass of resilient material.

8. An insert for use with an ice sports shoe having a sole, such as a ski boot or an ice skate, said insert comprising a foot supporting plate-like portion arranged to support the user's foot, said plate-like portion being shaped so as to laterally tiltably fit inside the shoe and rest upon the sole, and having means arranged to permit lateral tilting of the foot with respect to the sole upon inversion of eversion of the user's foot when said insert is in place inside the shoe comprising a rear heel balance means disposed at the lower surface at one end of said plate-like portion and a front toe balance means disposed at said lower surface opposite said rear balance means, said insert being configured so that when said insert is in its free state said upper surface does not necessarily conform to the sole of the foot of a user, but said insert being made of a flexible material so as to conform to the shape of the foot of the user when the ice sports shoe is operatively mounted on the foot of a user.

9. An insert as defined in claim 8 wherein said insert includes a metatarsal balance means disposed intermediate the ends of said insert in position not normally to do so, but to contact the sole when the shoe is operationally mounted on the foot of a user.

10. An insert as defined in claim 8 wherein said insert is an integrally formed unit.

11. An insert as defined in claim 8 wherein said insert comprises a plate-like member formed of a flexible material, and said rear balance means comprises a separate mass of resilient material.

12. An insert as defined in claim 8 wherein said plate-like portion has a socket formed in its lower side at the heel portion thereof, and said rear balance means comprises a separate post having a portion disposed in said socket.

* * * * *